US006481619B1

(12) United States Patent
Jackson

(10) Patent No.: US 6,481,619 B1
(45) Date of Patent: Nov. 19, 2002

(54) PRODUCE CONTAINER AND METHOD FOR MAKING THE SAME

(75) Inventor: Keith A. Jackson, Gurnee, IL (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 09/693,387

(22) Filed: Oct. 20, 2000

Related U.S. Application Data

(60) Provisional application No. 60/161,104, filed on Oct. 22, 1999.

(51) Int. Cl.[7] ..... B65D 21/032; B31B 1/26

(52) U.S. Cl. ..... 229/169; 206/509; 229/170; 229/174; 229/918; 229/919; 493/162

(58) Field of Search ..... 229/169, 170, 229/174, 915, 918, 919; 206/509, 511, 512; 493/162, 167–174

(56) References Cited

U.S. PATENT DOCUMENTS

| | | | | |
|---|---|---|---|---|
| 2,784,900 A | * | 3/1957 | Bauer | 229/169 |
| 2,868,430 A | * | 1/1959 | Hamilton | 229/169 |
| 3,036,753 A | * | 5/1962 | Davis et al. | 229/915 |
| 3,820,706 A | | 6/1974 | Gibson et al. | |
| 3,863,831 A | | 2/1975 | Wozniacki et al. | |
| 3,871,570 A | | 3/1975 | Garmon | |
| 3,910,484 A | | 10/1975 | Wozniacki | |
| 3,940,053 A | | 2/1976 | Putman et al. | |
| 4,053,098 A | | 10/1977 | Baptist | |
| 4,053,100 A | | 10/1977 | Baptist | |
| 4,082,215 A | | 4/1978 | Eichenauer | |
| 4,101,048 A | | 7/1978 | Rieben et al. | |
| 4,151,948 A | | 5/1979 | de la Fuente, Jr. | |
| 4,175,691 A | | 11/1979 | Cornell et al. | |
| 4,291,830 A | | 9/1981 | Sorensen | |
| 4,304,351 A | | 12/1981 | Stollberg | |
| 4,335,843 A | | 6/1982 | Kent | |
| 4,347,969 A | | 9/1982 | Kost et al. | |
| 4,349,147 A | | 9/1982 | Jensen | |
| 4,385,721 A | | 5/1983 | Olsen et al. | |
| 4,389,013 A | * | 6/1983 | Hall et al. | 229/915 |
| 4,391,405 A | | 7/1983 | Drinon | |
| 4,418,863 A | | 12/1983 | Kimbrell, Sr. | |

(List continued on next page.)

FOREIGN PATENT DOCUMENTS

| | | |
|---|---|---|
| FR | 2 728867 A1 | 12/1994 |
| WO | WO 99/43560 | 9/1999 |

*Primary Examiner*—Gary E. Elkins
(74) *Attorney, Agent, or Firm*—Jenkens & Gilchrist

(57) ABSTRACT

A produce container comprises a bottom wall, a pair of opposing side walls, a front wall, and a back wall. The front and back walls are reinforced along their tops by partial rollovers, each of which comprises two flanges—a center flange and a major flange—hingedly attached to the wall being reinforced. Each rollover is formed by first folding the center flange slightly away from the major flange and then folding the major flange downward toward the corresponding wall. Folding the major flange captures the center flange and at the same time forms doubled, indexed stacking tabs whose tops are formed along the axis about which the major flap is folded. The corners where the side walls and front and back walls join are reinforced by corner structures, with the corner structures extending along a portion of each of the joining walls so that the corners are reinforced along each wall with at least two layers of vertically-corrugated paperboard. The corners are further reinforced by shoulders extending across the top of the container at the corners and affixed to the side walls and the front and back walls where they join. The shoulders extend a short distance inward toward the center of the box and, in addition to reinforcing the corners, serve to prevent stacked containers from nesting.

27 Claims, 5 Drawing Sheets

U.S. PATENT DOCUMENTS

| | | | | | |
|---|---|---|---|---|---|
| 4,537,344 | A | | 8/1985 | Thomas | |
| 4,567,996 | A | | 2/1986 | Muise | |
| 4,600,142 | A | | 7/1986 | Quaintance | 229/143 |
| 4,613,045 | A | | 9/1986 | Watson | 206/512 |
| 4,676,429 | A | | 6/1987 | Crowe et al. | 229/109 |
| 4,770,339 | A | | 9/1988 | Weimer | 229/143 |
| 4,860,948 | A | * | 8/1989 | Hofstede | 229/918 |
| 4,883,221 | A | | 11/1989 | Brundage | |
| 4,946,093 | A | | 8/1990 | Moorman | 229/128.19 |
| 5,000,377 | A | | 3/1991 | McClure | 229/154 |
| 5,002,224 | A | | 3/1991 | Muise | 229/169 |
| 5,052,615 | A | | 10/1991 | Ott et al. | 229/182 |
| 5,125,567 | A | | 6/1992 | McClure | 229/150 |
| 5,139,196 | A | | 8/1992 | Fry et al. | 229/157 |
| 5,163,609 | A | | 11/1992 | Muise, Jr. | 229/113 |
| 5,261,594 | A | | 11/1993 | Brown et al. | 229/191 |
| 5,285,956 | A | | 2/1994 | Piepho | 229/191 |
| 5,289,970 | A | | 3/1994 | McClure | 229/143 |
| 5,294,044 | A | | 3/1994 | Clark | 229/191 |
| 5,330,094 | A | | 7/1994 | Mertz | 229/167 |
| 5,361,975 | A | | 11/1994 | Droste et al. | 229/120.34 |
| 5,361,976 | A | | 11/1994 | Blomfield | 229/148 |
| 5,370,303 | A | | 12/1994 | Fry | 229/143 |
| 5,392,985 | A | | 2/1995 | Smith et al. | 229/125 |
| 5,516,034 | A | | 5/1996 | Jensen et al. | 229/120 |
| 5,535,941 | A | | 7/1996 | Garza | 229/191 |
| 5,649,663 | A | | 7/1997 | Pestow, Jr. | 229/190 |
| 5,673,848 | A | | 10/1997 | Garza | 229/191 |
| 5,687,902 | A | | 11/1997 | Tusing et al. | 229/198.1 |
| 5,704,193 | A | | 1/1998 | Roe et al. | 53/397 |
| 5,853,120 | A | | 12/1998 | McLeod et al. | 229/120.09 |
| 5,860,590 | A | | 1/1999 | Blomfield et al. | 229/165 |
| 5,979,746 | A | | 11/1999 | McLeod et al. | 229/120.09 |

* cited by examiner

Fig. 5
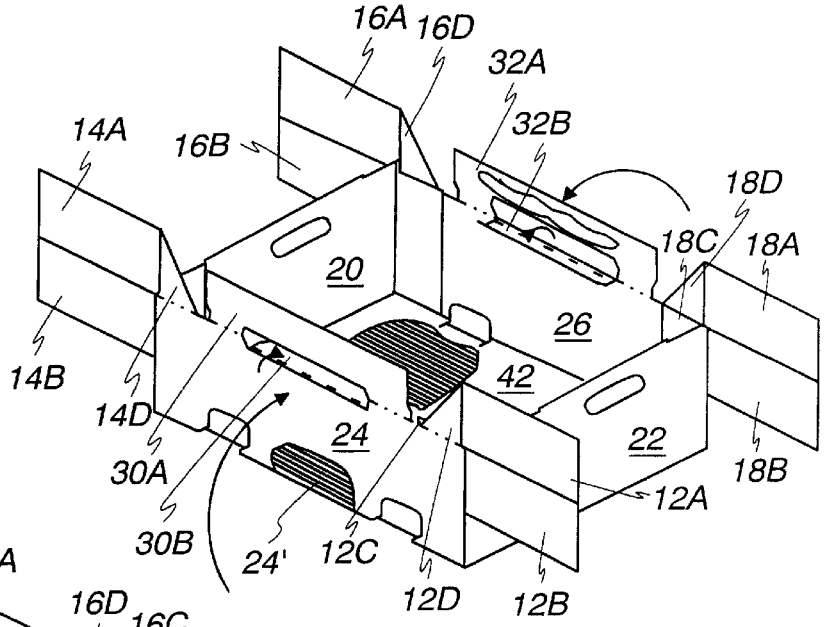
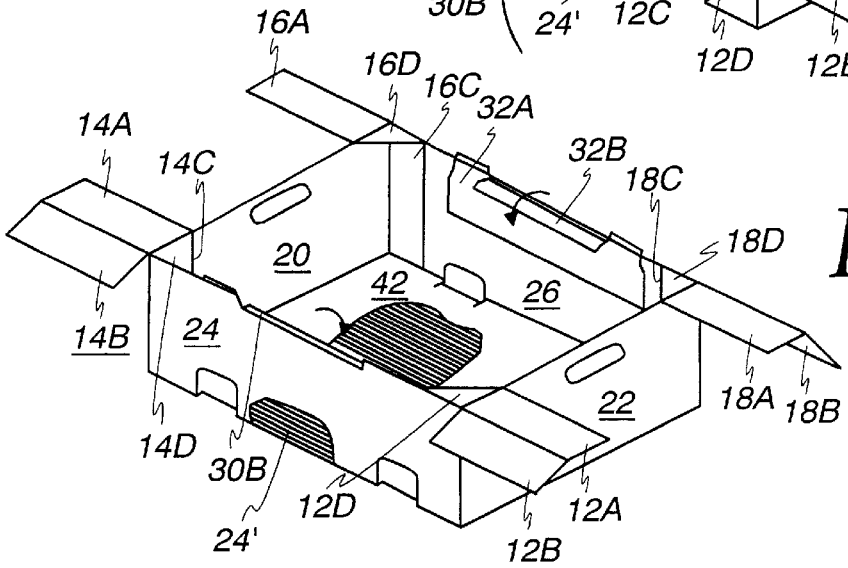
Fig. 6
Fig. 7
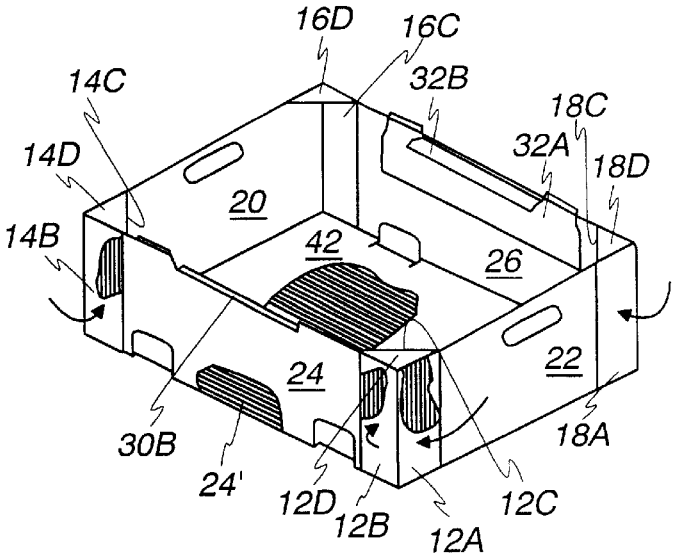

PRODUCE CONTAINER AND METHOD FOR MAKING THE SAME

RELATED APPLICATION

This application claims priority to the United States Provisional Patent Application entitled, "Produce Container and Method for Making the Same," filed on Oct. 22, 1999 and granted Ser. No. 60/161,104.

FIELD OF THE INVENTION

The present invention relates generally to containers for retaining, protecting and displaying produce and methods for making such containers. In particular, the present invention relates to a produce container having an open top formed from corrugated paperboard material and useful in shipping and displaying perishable produce.

BACKGROUND OF THE INVENTION

Flat sheets of corrugated paperboard, typically referred to as blanks, have been used for many years as the starting material to form produce containers. Corrugated paperboard generally refers to a multi-layer sheet material comprised of two sheets of liner bonded to a central corrugated layer of medium. Given a basic size requirement specified by the customer, industry standards, and the preference for low cost, paperboard container manufacturers strive to provide structural stacking strength with a minimal amount of corrugated paperboard. A typical well-known container is a single-piece tray design having a bottom wall, two side walls and two end walls each hinged to the bottom wall. Typically, a single piece of corrugated paperboard will be cut and scored to form a flat blank that will then be erected into this container.

Typical containers for the support and transport of food produce articles are corrugated containers having fixed configurations. These containers can be unstable when stacked and are prone to toppling. Many containers are not durable and flexible enough to protect and prevent damage to the produce. Furthermore, the side and bottom walls of produce containers are susceptible to buckling and twisting, leading to damage to the produce.

A packed container of produce will generally hold a weight suitable for handling by an individual. Such containers will be generally rectangular and have a variable height dimension. Further, these containers will normally be stacked for transport and storage. The cost of labor, in the form of the time required to handle the produce and to assemble the shipping containers, can be a significant factor in the overall cost of the produce. Many current produce containers can only be assembled by hand, a method that is costly and time consuming. Assembling paperboard containers for set-up by a machine where cooperating adjoining paperboard sections are adhesively bonded to form the produce container can reduce cost and time.

It is important in the production, distribution and sale of perishable and nonperishable articles such as produce that the articles are safely and conveniently stored for transport and safely and securely shipped for sale. Safe and secure storage and shipping is particularly a problem if heavy items must be placed in containers that are stacked upon each other. Stackable produce containers often acquire, for example, bulging side or end walls, deformed bottom walls, or smashed corners that damage the produce due to, for example, the weight of or movement of the produce during shipment. Further, if the environment in which the paperboard container is shipped or stored is refrigerated, the moisture present in a refrigerated environment is likely to be absorbed by and weaken the container.

Once the produce reaches a retail destination, the produce container is normally placed directly on display for consumer sale. This allows retailers to preserve time and money by not having to transfer produce into an alternative selling container. If a produce container arrives to a retailer in a crushed or damaged state, however, the retailer usually cannot, for aesthetic purposes, exhibit the produce container.

Vertically oriented corrugation fibers within a produce container are typically stronger and more secure than horizontally orientated fibers. Without structural rigidity, containers at or near the bottom of a stack of produce containers could buckle under the weight of the containers stacked above them. Generally, the end walls of a produce container contain vertically orientated corrugation fibers. Thus, it is preferable for the end walls to contain as few openings as possible. Optimal cooling efficiency, which enhances produce quality and shelf life, is also desirable. Cooling is achieved by including openings in each end wall to allow cool air flow from one end of the container to the other.

Thus, it is desirable to provide a container for transporting produce that is both durable and secure to prevent corrugation failure and produce damage and yet allows sufficient air flow to achieve optimal cooling efficiency.

SUMMARY OF THE INVENTION

Accordingly, an object of the present invention is to provide a produce container featuring superb stacking strength and resistance to forces encountered in shipping that tend to weaken standard produce containers. Another object of the present invention is to provide such a produce container that is cost-effective and easy to manufacture.

These and other objects are realized by a produce container comprising a bottom wall and a plurality of side walls. The corners where the side walls meet are comprised of multiple layers of vertically corrugated reinforcement flaps. The corners further contain shoulders attached to a side wall and a reinforcement flap at each corner. The shoulders prevent nesting of stacked containers and extend across a portion of the top of the container, running generally parallel to the bottom wall.

To further lend structural strength to the container, a plurality of side walls feature partial rollovers along their top edges. These partial rollovers comprise a major flange, which is cut around a center flange. The center flange is first folded about one axis down toward the side wall and the major flange is then folded about a second axis so as to capture the center flange between the major flange and the side wall. The folding axis of the major flange corresponds to the tops of a plurality of simultaneously-formed doubled indexed stacking tabs.

BRIEF DESCRIPTION OF THE DRAWINGS

Other objects and advantages of the invention will become apparent upon reading the following detailed description and upon reference to the drawings in which:

FIGS. 4 through 7 are perspective views illustrating the sequence in which the panels of the blank in FIG. 2 are folded to form the stackable, displayable produce container in FIG. 1;

Figure 1:
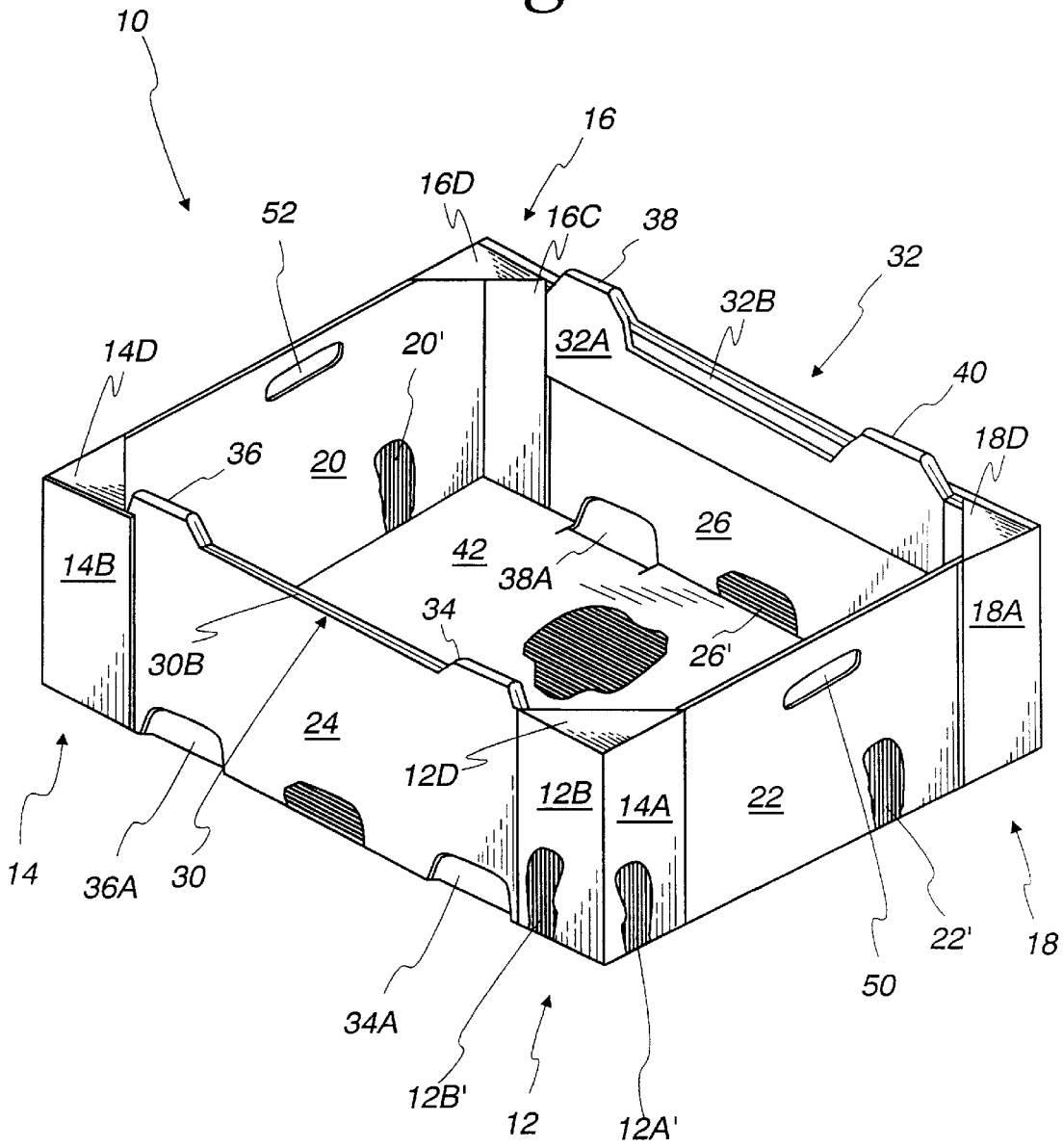
FIG. 1 is a perspective view of a stackable, displayable produce container embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

A successful design for a produce container must overcome many obstacles to achieve superior performance. A produce container must be inexpensive and easy to assemble. At the same time, a produce container must have tremendous structural integrity to prevent produce damage that could occur if the container were to collapse. This structural integrity must be maintained against forces encountered when produce containers are stacked and transported. Further, the containers must be easy to stack atop of one another and, when stacked, the containers must retain great stacking strength and stability. A produce container may incorporate holes in its side walls to allow for access holes and airflow vents. It is also desirable for a produce container to be displayable to consumers at grocery stores and to allow for the greatest amount of produce to be contained within the container while using a limited amount of material.

In the past, attempted solutions to these problems have led to their own resultant problems, since solving one problem often exacerbates another. For example, corner structures that increase stacking strength commonly include elements that protrude into the container, reducing the amount of produce the container can hold. As another example, cutting access holes and vents into a produce container's side walls reduces the structural integrity of a produce container that relies on its side walls for key structural support. Common designs that include tab structures to facilitate stacking often include these structures on separate reinforcing elements, reducing the likelihood of proper alignment of stacking tabs during container assembly.

Finally, even containers that feature acceptable stacking strength and structural integrity often encounter the problem of nesting. Nesting arises when a stacked produce container falls into a lower produce container. This may arise when the walls of a lower container bulge or when stacking tabs misalign slightly, leaving the upper container free to be jostled about during shipment. Nesting can result in produce in the lower container being crushed by the stacked container. If lower containers in a stack get nested unevenly, an entire stack of produce containers can topple. One solution to the problem of nesting is to extend full-length platforms across the top of a container, but this solution requires a substantial amount of material and also reduces the sight lines into the container when it is on display.

Figure 2:
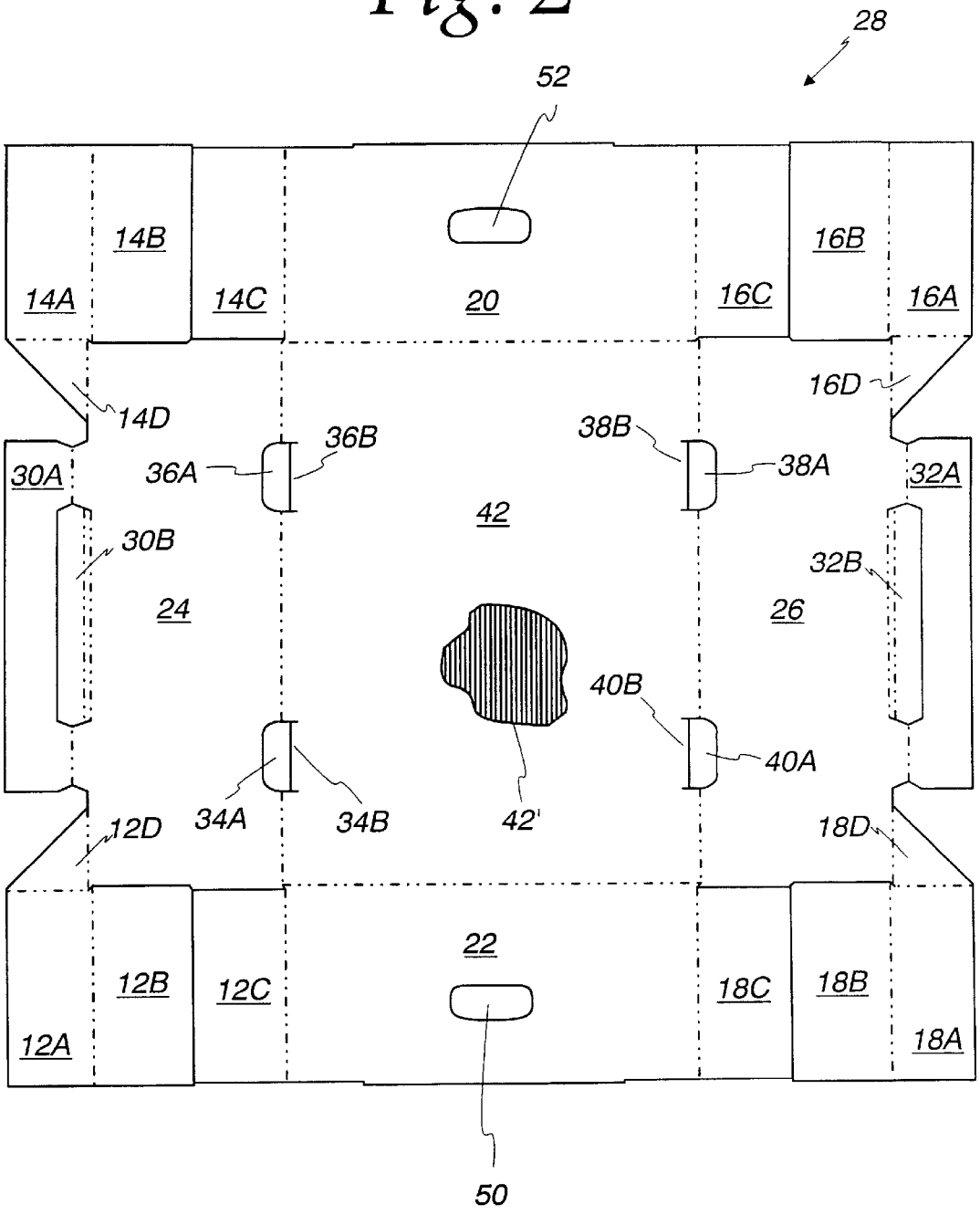
FIG. 2 is a plan view of the inner surface of a blank for forming the stackable, displayable produce container in FIG. 1.

A stackable, displayable produce container 10, as shown in FIG. 1, is a preferred embodiment of the present invention, solving the problems described above with a minimum of negative compromise. The produce container 10 is preferably constructed of corrugated paperboard but it will be appreciated that the produce container 10 could alternatively be constructed of solid fiber board, heavy paperboard, heavy plastic sheeting, or other suitable rigid construction materials. Much of the structural integrity and stacking strength of produce container 10 arises from its corner structures 12, 14, 16, and 18. When fully assembled, the corner structures 12, 14, 16, and 18 of container 10 are attached to and join together adjacent ones of side walls 20 and 22, front wall 24, and back wall 26. The corner structures, as illustrated in FIGS. 1 and 2 are comprised of external comer reinforcement flaps 12A, 12B, 14A, 14B, 16A, 16B, 18A and 18B, internal corner reinforcement flaps 12C, 14C, 16C and 18C, and shoulders 12D, 14D, 16D and 18D.

Because all four corner structures are constructed analogously, a description of one corner structure can be easily extended to each other corner structure. Areas where adhesive is applied during the formation process are indicated in the figures by open areas bounded by curvilinear shapes. In corner structure 12, external corner reinforcement flap 12A is glued to side wall 22 and hingedly attached to external corner reinforcement flap 12B and to shoulder 12D. External corner reinforcement flap 12B is glued to the outside of front wall 24, and internal corner reinforcement flap 12C (shown in FIG. 4) is glued to the inside of front wall 24 and hingedly attached to side wall 22.

The structural integrity of corrugated paperboard is related to its corrugation pattern or fluting structure. Corrugated paperboard is typically structurally strongest against forces applied in line with its fluting structure and structurally weakest against forces applied perpendicular to its fluting structure. During shipping and stacking, produce containers are subject to vertically-aligned forces such as the weight of produce containers stacked above a lower container and the forces encountered when a container is lifted or dropped. Thus, if a produce container relies on its corner structures for much of its structural integrity, as produce container 10 does, a design that maximizes the vertical fluting structure on the corner structures will be stronger than a design with fewer components having vertical fluting in the corner structures.

Figure 4:
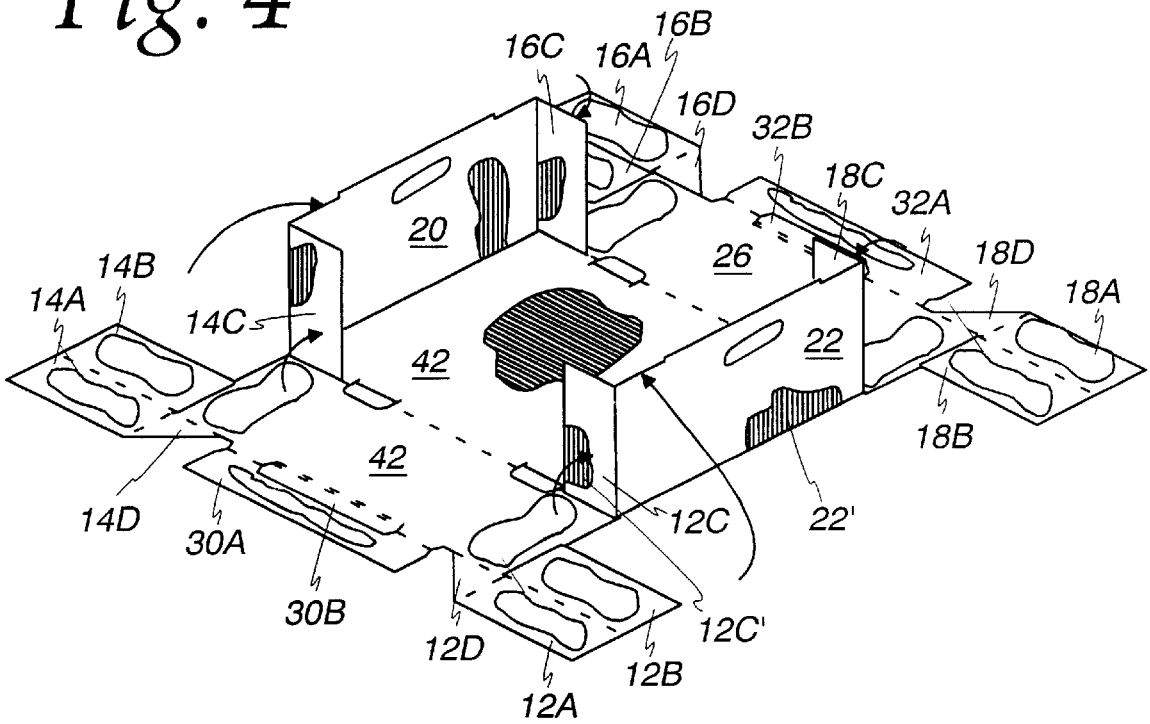

Vertical fluting is maximized in the corner structures 12, 14, 16 and 18 of produce container 10 by aligning multiple layers of vertically fluted corrugated paperboard at the corners. For example, in corner structure 12, exterior corner reinforcement flap 12A and side wall 22 are comprised of corrugated paperboard with respective vertically fluted corrugation patterns 12A' and 22'. Thus, when exterior corner reinforcement flap 12A and side wall 22 are glued together, a double thickness of vertically corrugated paperboard results. Similarly, external corner reinforcement flap 12B and internal corner reinforcement flap 12C (as shown in FIG. 4) are comprised of corrugated paperboard with respective vertically fluted corrugation patterns 12B' and 12C'. When produce container 10 is formed, front wall 24, having horizontally fluted corrugation pattern 24', is sandwiched between two layers of vertically corrugated paperboard at the corners. The result is a strong triple thickness of corrugated paperboard with two layers of vertically corrugated paperboard. This structure exists at each of the four corner structures 12, 14, 16, and 18 of produce container 10, giving rise to superior stacking strength. When identical produce containers of this invention are stacked, vertical fluting on reinforced corners aligns with fluting on containers above and below to produce an extremely strong column of multi-layered, vertically fluted reinforcement members. Because the produce container 10 achieves much of its structural strength at its corners, the front wall 24, back wall 26, and side walls 20 and 22 can accept vent holes or access holes without greatly compromising the overall strength of produce container 10.

External corner reinforcement flaps 12A and 12B, internal corner reinforcement flap 12C, and shoulder 12D in corner structure 12 are analogous, respectively, to external corner reinforcement flaps 14A and 14B, internal corner reinforcement flap 14C, and shoulder 14D in corner structure 14, to external corner reinforcement flaps 16A and 16B, internal corner reinforcement flap 16C, and shoulder 16D in corner structure 16, and to external corner reinforcement flaps 18A and 18B, internal corner reinforcement flap 18C, and shoulder 18D in corner structure 18.

The problem of nesting, discussed above, is solved by the use of shoulders 12D, 14D, 16D and 18D. These shoulders protrude inward from each corner along the top of produce container 10, and may be triangle shaped as shown in FIG. 1 or otherwise shaped. If a stack of produce containers is jostled during shipment or incorrectly stacked so that individual containers get misaligned, shoulders 12D, 14D, 16D, and 18D are sufficiently wide that one container stacked atop another will not tend to nest into the lower container. The size and shape of each of shoulders 12D, 14D, 16D, and 18D maximize the openness of the container while virtually eliminating the possibility if nesting.

Because front wall 24 and back wall 26 are comprised of paperboard with respective horizontally fluted corrugation patterns 24' and 26', walls 24 and 26 would normally have significantly less structural integrity against vertical forces than side walls 20 and 22 or corner structures 12, 14, 16, and 18. In addition to this reduced structural integrity, standard single-layer walls are prone to fraying along their tops during use, and such fraying further weakens the integrity of standard produce container walls, leading to wall bulge, a precursor to nesting. These are two problems solved by partial rollovers 30 and 32.

Figure 3:
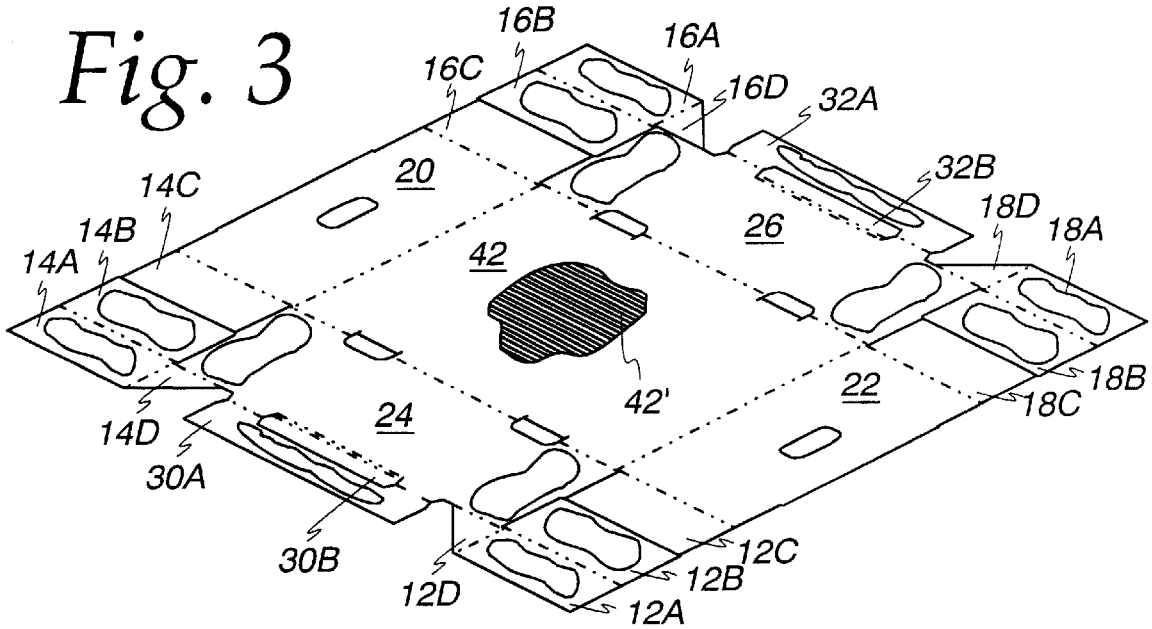
FIG. 3 is a perspective view of the inner surface of the blank in FIG. 2, before the forming process.

As shown in FIG. 3, a partial rollover 30 is comprised of major rollover flange 30A, center rollover flange 30B, and the upper portion of front wall 24. In the forming process, as shown in FIGS. 5 and 6, center rollover flange 30B is first slightly folded toward the inner surface of front wall 24. After this initial slight fold, major rollover flange 30A is fully folded inward toward and then glued or laminated to the inner surface of front wall 24. Center rollover flange 30B is thus captured between major rollover flange 30A and the inner surface of front wall 24. The result is a three-layer structure of horizontally corrugated paperboard at partial rollover 30, with the two outer layers hingedly connected. Having the two outer layers hingedly connected reduces the problem of fraying, since no cut paperboard is exposed along a hinge line. In addition, the threelayer structure of horizontally corrugated paperboard that forms rollovers 30 and 32 makes front wall 24 and back wall 26 much more resistant than standard single-layer walls to wall bulge and to internal and external pressures that could cause the walls to buckle. Due to the symmetry of produce container 10, rollover 32 is formed analogously to rollover 30, with major rollover flange 30A being analogous to major rollover flange 32A and center rollover flange 30B being analogous to center rollover flange 30B. In addition to bolstering the structural integrity of front wall 24 and back wall 26 and reducing the problem of fraying at the tops of the walls, rollovers 30 and 32 provide a "shelf" for stacking items such as identical produce containers or half-size produce containers atop produce container 10. It will be appreciated that the partial rollover structures could also be formed by bending the major and center rollover flanges toward the outside of the container rather than toward the inside. The partial rollover structures could alternatively be formed without a center flange so that the finished rollover comprises two layers of horizontally corrugated paperboard.

The process of forming rollovers 30 and 32 simultaneously forms stacking tabs 34, 36, 38 and 40. For example, when major rollover flange 30A is folded down toward the inner surface of front wall 24, it is folded about an axis that is aligned with the tops of doubled indexed stacking tabs 34 and 36. These tabs are called "doubled tabs" because after the construction of rollover 30, tabs 34 and 36 consist of two layers of horizontally corrugated paperboard hingedly linked to one another. Further, tabs 34 and 36 are considered "indexed" because they are formed along with the unitary structure of rollover 30. This is in contrast to commonly used tabs, which are formed on different minor flanges. Forming tabs on different minor flanges leaves room for the possibility that the tabs will be misaligned during construction, resulting in improper insertion into a corresponding slot and leading to possible wall bulging, nesting, toppling, and other structural failures. Forming tabs 34 and 36 along one unitary piece of material eliminates the possibility of misalignment since the distance between the tabs and tab orientation created during the manufacture of blank 28 will be retained throughout the container construction process. When produce containers of the present embodiment are stacked, tabs 34, 36, 38 and 40, respectively, align with and insert into slots 34A, 36A, 38A and 40A. Slots 34A, 36A, 38A and 40A are cut with bendable flaps 34B, 36B, 38B and 40B (as shown in FIG. 2) to facilitate perfect alignment with tabs 34, 36, 38 and 40.

FIGS. 3 through 7 display how produce container 10 is formed out of blank 28, either by hand folding or machine folding. First, as shown in FIG. 4, side walls 20 and 22 are folded upward into a vertical position, and internal corner reinforcement flaps 12C, 14C, 16C and 18C are folded approximately 90 degrees inward from side walls 20 and 22. The formation of each of these structures creates vertical fluting structures 20', 22', 12C', 14C', 16C', and 18C' (not visible) in the side walls and internal corner reinforcement flaps. Second, as illustrated in FIG. 5, front wall 24 and back wall 26 are folded upward to a vertical position. The formation of front wall 24 and back wall 26 creates horizontal fluting structures 24' and 26'. In this step, internal corner reinforcement flaps 12C and 14C are glued or laminated to the inside of front wall 24 and internal corner reinforcement flaps 16C and 18C are glued or laminated to the inside of back wall 26.

Third, rollovers 30 and 32 and shoulders 12D, 14D, 16D and 18D are formed as shown in FIGS. 5 and 6. Specifically, rollover 30 is formed by first pressing center rollover flange 30B inward and then folding major rollover flange 30A inward, capturing center rollover flange 30B between major rollover flange 30A and the inside of front wall 24. Rollover 32 is formed by first pressing center rollover flange 32B inward and then folding major rollover flange 32A inward, capturing center rollover flange 32B between major rollover flange 32A and the inside of back wall 26. During this step, major rollover flanges 30A and 32A are respectively glued or laminated to front wall 24 and back wall 26. Thus, rollover formation results in a triple thickness of horizontally corrugated paperboard at the rollovers. Shoulders 12D, 14D, 16D and 18D are formed by folding each shoulder inward so that the shoulders are parallel to bottom wall 42. Since external corner reinforcement flaps 12A, 12B, 14A, 14B, 16A, 16B, 18A and 18B are connected to the shoulders, the external corner reinforcement flaps are also brought to a position parallel with bottom wall 42.

Fourth, corner structure formation is completed by folding down and wrapping around the external corner reinforcement flaps as shown in FIGS. 6 and 7. Since all corner structures are formed analogously, a description of the formation of corner structure 12 can be extended to describe the formation of corner structures 14, 16 and 18. First, external corner reinforcement flaps 12A and 12B are folded downward so that external corner reinforcement flap 12A is glued or laminated to side wall 22. Second, external corner reinforcement flap 12B is folded around toward front wall 24 and glued or laminated to front wall 24. This completes the construction of corner structure 12 and vertically aligns fluting structures 12A' and 12B'. Folding the corner structures together in this manner allows the external corner reinforcement flaps to be folded downward and wrapped around from the outside, facilitating the formation of produce container 10 by machine as well as by hand.

Figure 8:
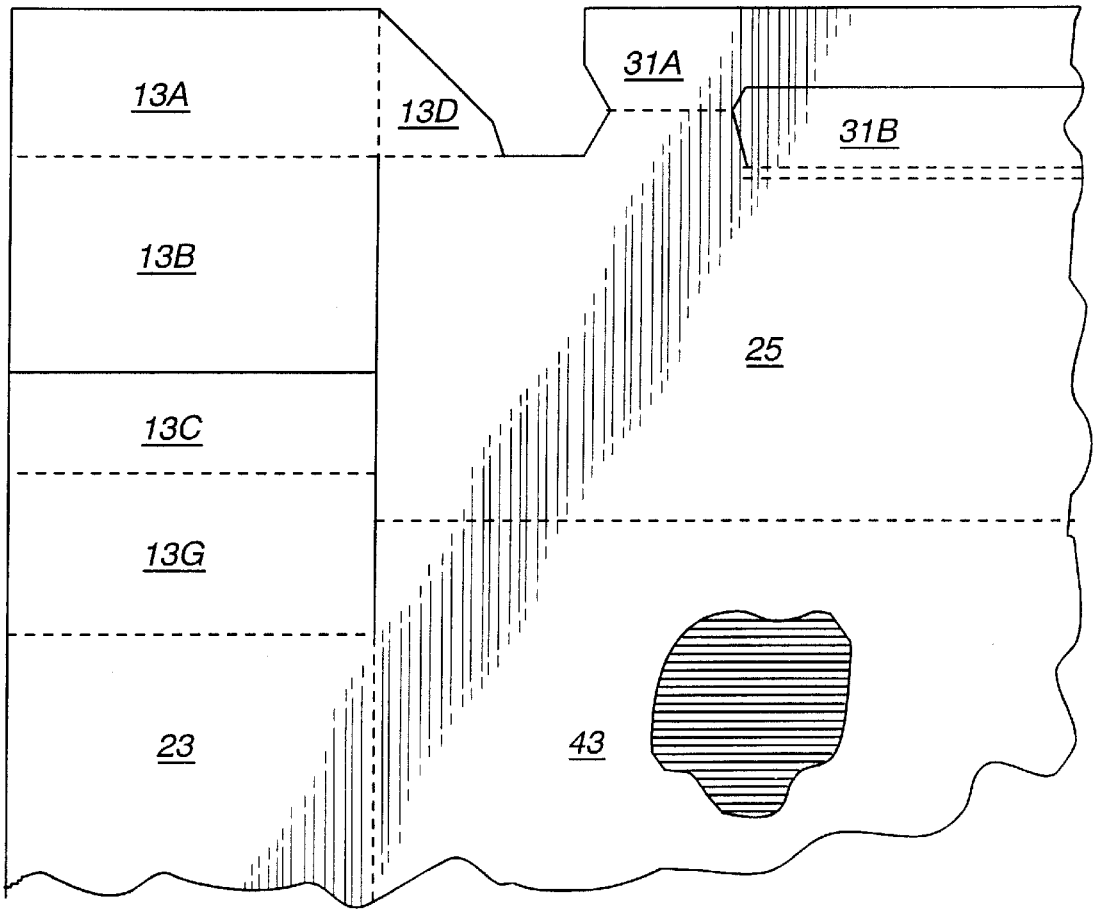
FIG. 8 is a plan view of a section of the inner surface of a blank for forming an alternative embodiment of the stackable, displayable produce container of this invention.
Figure 9:
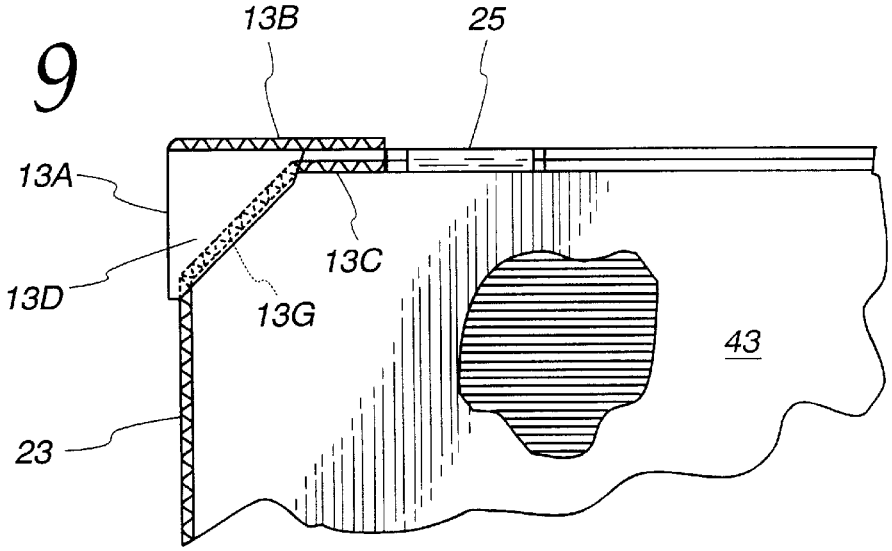
FIG. 9 is a top view of a comer of the stackable, displayable produce container of the alternative embodiment of FIG. 8.

While the present invention has been described with reference to one or more particular embodiments, those skilled in the art will recognize that many changes may be made thereto without departing from the spirit and scope of the present invention. For example, alternative corner reinforcement structures may be formed as shown in FIGS. 8 and 9. This alternative embodiment differs from the first embodiment in that the internal corner reinforcement flap, corresponding to, for example, flap 12C, is cut longer and scored for folding so that flaps 13C and 13E extend outward from side wall 23 as shown in FIG. 8. Thus, instead of including a single internal reinforcement flap that rests flush against its corresponding front or back wall for its entire length as flap 12C does, this alternative embodiment uses diagonal reinforcement flap 13E which extends diagonally through the body of the container. Internal reinforcement flap 13C is hingedly attached to diagonal reinforcement flap 13E and is glued or laminated flush against front wall 25. Shoulder 13D and external corner reinforcement flaps 13A and 13B are wrapped around the corner as in the first embodiment, and rollover flanges 31A and 31B operate analogously to, for example, rollover flanges 30A and 30B. It will be appreciated that this alternative corner reinforcement structure could be constructed with diagonal reinforcement flap 13E having a range of possible widths, with the angles between side panel 23, diagonal reinforcement flap 13E, and internal reinforcement flap 13C also being variable. Each of these embodiments and obvious variations thereof is contemplated as falling within the spirit and scope of the claimed invention, which is set forth in the following claims.

What is claimed is:

1. A produce container, comprising: a bottom wall, a plurality of side walls extending upward from said bottom wall, and a plurality of partial rollovers extending atop corresponding ones of said plurality of side walls, each of said rollovers comprising a major flange, hingedly attached to the top of the corresponding side wall and folded downward around an axis corresponding to the tops of a plurality of simultaneously-formed doubled, indexed stacking tabs extending upward from each of said partial rollovers, each of said partial rollovers further comprising center flange captured between said major flange and said corresponding side wall.

2. A produce container, comprising: a bottom wall, a plurality of side walls extending upward from said bottom wall, a plurality of partial rollovers extending atop corresponding ones of said plurality of side walls, each of said rollovers comprising a major flange, hingedly attached to the top of the corresponding side wall and folded downward around an axis corresponding to the tops of a plurality of simultaneously-formed doubled, indexed stacking tabs extending upward from each of said partial rollovers, and a plurality of corner reinforcement structures extending along said side walls at said corners, at least one of said corner reinforcement structures comprising two vertically corrugated external reinforcement flaps and one vertically corrugated internal reinforcement flap, said external reinforcement flaps integral with the outsides of both side walls joined at the corresponding corner of said at least one corner reinforcement structure and said internal reinforcement flap integral with the inside of one of said side walls, said external and internal reinforcement flaps partially extending down their respective walls.

3. The produce container of claim 2 wherein said side walls number four.

4. The produce container of claim 2 wherein a plurality of holes are cut into said side walls.

5. The produce container of claim 2 wherein each of said partial rollovers further comprises a center flange captured between said major flange and said corresponding side wall.

6. The produce container of claim 2 wherein said produce container is comprised of corrugated paperboard.

7. The produce container of claim 6 wherein said rollovers are comprised of horizontally-corrugated paperboard.

8. A produce container, comprising: a bottom wall, a plurality of side walls extending upward from said bottom wall, each of said side walls meeting with adjacent side walls at corners, a plurality of partial rollovers extending atop corresponding ones of said plurality of side walls, each of said rollovers comprising a major flange, hingedly attached to the top of the corresponding side wall and folded downward around an axis corresponding to the tops of a plurality of simultaneously-formed doubled, indexed stacking tabs extending upward from each of said partial rollovers, and a plurality of shoulders integral with adjacent ones of said side walls and extending inward across the top of said produce container at said corners, said shoulders being approximately parallel to said bottom wall.

9. The produce container of claim 8 wherein said side walls number four.

10. The produce container of claim 8 wherein a plurality of holes are cut into said side walls.

11. The produce container of claim 8 wherein each of said partial rollovers further comprises a center flange captured between said major flange and said corresponding side wall.

12. The produce container of claim 8 wherein said produce container is comprised of corrugated paperboard.

13. The produce container of claim 12 wherein said rollovers are comprised of horizontally corrugated paperboard.

14. A produce container, comprising: a bottom wall, a plurality of side walls extending upward from said bottom wall, a plurality of corner reinforcement structures extending along said side walls at said corners, at least one of said corner reinforcement structures comprising two vertically corrugated external reinforcement flaps and one vertically corrugated internal reinforcement flap, said external reinforcement flaps integral with the outsides of both side walls joined at the corresponding corner of said at least one corner reinforcement structure and said internal reinforcement flap integral with the inside of one of said side walls, said external and internal reinforcement flaps partially extending down their respective walls, and a plurality of shoulders integral with adjacent ones of said side walls and extending inward across the top of said produce container at said corners, said shoulders being approximately parallel to said bottom wall.

15. The produce container of claim 14 wherein said side walls number four.

16. The produce container of claim 14 wherein a plurality of holes are cut into said side walls.

17. The produce container of claim 14 wherein said produce container is comprised of corrugated paperboard.

18. A produce container, comprising: a bottom wall, a plurality of side walls extending upward from said bottom wall, each of said side walls meeting with adjacent side walls at corners, a plurality of partial rollovers extending atop corresponding ones of said plurality of side walls, each of said rollovers comprising a major flange, hingedly attached to the top of the corresponding side wall and folded downward around an axis corresponding to the tops of a plurality of simultaneously-formed doubled, indexed stacking tabs extending upward from each of said partial rollovers, a plurality of corner reinforcement structures extending along said side walls at said corners, at least one of said corner reinforcement structures comprising two vertically corrugated external reinforcement flaps and one vertically corrugated internal reinforcement flap, said external reinforcement flaps integral with the outsides of both side walls joined at the corresponding corner of said at least one corner reinforcement structure and said internal reinforcement flap integral with the inside of one of said side walls, said external and internal reinforcement flaps partially extending down their respective walls, and a plurality of shoulders integral with adjacent ones of said side walls and extending inward across the top of said produce container at said corners, said shoulders being approximately parallel to said bottom wall.

19. The produce container of claim 18 wherein said side walls number four.

20. The produce container of claim 18 wherein a plurality of holes are cut into said side walls.

21. The produce container of claim 18 wherein each of said partial rollovers further comprises a center flange captured between said major flange and said corresponding side wall.

22. The produce container of claim 18 wherein said produce container is comprised of corrugated paperboard.

23. The produce container of claim 22 wherein said rollovers are comprised of horizontally-corrugated paperboard.

24. A blank for forming a produce container, comprising a central rectangular panel having a first pair of opposing edges and a second pair of opposing edges, a first side wall panel hingedly connected to one of said first pair of opposing edges, a second side wall panel hingedly connected to the other of said first pair of opposing edges, a front wall panel hingedly connected to one of said second pair of opposing edges, and a back wall panel hingedly connected to the other of said second pair of opposing edges, a first pair of minor flaps extending from opposing ends of said first side wall panel, a second pair of minor flaps extending from opposing ends of said second side wall panel, a first major flange hingedly connected along an axis corresponding to doubled, indexed tabs to said front wall panel and first corresponding surrounded center flange hingedly connected to said front wall panel, a second major flange hingedly connected along an axis corresponding to doubled, indexed tabs to said back wall panel and second corresponding surrounded center flange hingedly connected to said back wall panel, a first pair of shoulder panels hingedly connected to the outside ends of said front wall panel with each of a first pair of dual external reinforcement panels hingedly connected to one of said first pair of shoulder panels, and a second pair of shoulder panels hingedly connected to the outside ends of said back wall panel with each of a second pair of dual external reinforcement panels hingedly connected to one of said second pair of shoulder panels.

25. A method of forming a produce container, said method comprising the steps of:

providing a blank comprising a bottom wall having a first pair of opposing edges and a second pair of opposing edges, a first side wall panel hingedly connected to one of said first pair of opposing edges, a second side wall panel hingedly connected to the other of said first pair of opposing edges, a front wall panel hingedly connected to one of said second pair of opposing edges, and a back wall panel hingedly connected to the other of said second pair of opposing edges, a first pair of minor flaps extending from opposing ends of said first side wall panel, a second pair of minor flaps extending from opposing ends of said second side wall panel, a first major flange hingedly connected along an axis corresponding to doubled, indexed tabs to said front wall panel and corresponding first surrounded center flange hingedly connected to said front wall panel, a second major flange hingedly connected along an axis corresponding to doubled, indexed tabs to said back wall panel and corresponding second surrounded center flange hingedly connected to said back wall panel, a first pair of shoulder panels hingedly connected to the outside ends of said front wall panel with each of a first pair of dual external reinforcement panels hingedly connected to one of said first pair of shoulder panels, and a second pair of shoulder panels hingedly connected to the outside ends of said back wall panel with each of a second pair of dual external reinforcement panels hingedly connected to one of said second pair of shoulder panels;

folding said first and second side wall panels upward approximately 90 degrees relative to said bottom wall;

folding said first and second pairs of minor flaps inward approximately 90 degrees relative to said side wall panels;

folding said front and back wall panels upward approximately 90 degrees relative to said bottom wall so that each of said first and second pairs of minor flaps is adhered to a corresponding one of said front and back wall panels;

folding said first and second surrounded center flanges slightly away from said first and second major flanges;

folding said first and second major flanges toward said first and second center flanges so as to capture said first and second center flanges between, respectively, said first and second major flanges and said front wall panel and said back wall panel, said major first and second major flanges being adhered, respectively to said front and back wall panels;

folding said first and second pairs of shoulder panels inward approximately 90 degrees relative, respectively, to said front and back wall panels;

folding said first and second pairs of dual external reinforcement panels downward approximately 90 degrees relative, respectively, to said first and second pairs of shoulder panels and adhering individual external reinforcement panels to corresponding ones of said side wall panels; and folding said first and second pairs of dual external reinforcement panels along a vertical crease line so that two external reinforcement are adhered to each of said front and back walls.

26. A blank for forming a produce container, comprising a central rectangular panel having a first pair of opposing edges and a second pair of opposing edges, a first side wall panel hingedly connected to one of said first pair of opposing edges, a second side wall panel hingedly connected to the other of said first pair of opposing edges, a front wall panel hingedly connected to one of said second pair of opposing edges, and a back wall panel hingedly connected to the other of said second pair of opposing edges, a first pair of double-paneled minor flaps extending from opposing ends of said first side wall panel, a second pair of double-paneled minor flaps extending from opposing ends of said second side wall panel, a first major flange hingedly connected along an axis corresponding to doubled, indexed tabs to said front wall panel and first corresponding surrounded center flange hingedly connected to said front wall panel, a second major flange hingedly connected along an axis corresponding to doubled, indexed tabs to said back wall panel and second corresponding surrounded center flange hingedly connected to said back wall panel, a first pair of shoulder panels hingedly connected to the outside ends of said front wall panel with each of a first pair of dual external reinforcement panels hingedly connected to one of said first pair of shoulder panels, and a second pair of shoulder panels hingedly connected to the outside ends of said back wall panel with each of a second pair of dual external reinforcement panels hingedly connected to one of said second pair of shoulder panels.

27. A method of forming a produce container, said method comprising the steps of:

providing a blank comprising a bottom wall having a first pair of opposing edges and a second pair of opposing edges, a first side wall panel hingedly connected to one of said first pair of opposing edges, a second side wall panel hingedly connected to the other of said first pair of opposing edges, a front wall panel hingedly connected to one of said second pair of opposing edges, and a back wall panel hingedly connected to the other of said second pair of opposing edges, a first pair of double-paneled minor flaps extending from opposing ends of said first side wall panel, a second pair of double-paneled minor flaps extending from opposing ends of said second side wall panel, a first major flange hingedly connected along an axis corresponding to doubled, indexed tabs to said front wall panel and corresponding first surrounded center flange hingedly connected to said front wall panel, a second major flange hingedly connected along an axis corresponding to doubled, indexed tabs to said back wall panel and corresponding second surrounded center flange hingedly connected to said back wall panel, a first pair of shoulder panels hingedly connected to the outside ends of said front wall panel with each of a first pair of dual external reinforcement panels hingedly connected to one of said first pair of shoulder panels, and a second pair of shoulder panels hingedly connected to the outside ends of said back wall panel with each of a second pair of dual external reinforcement panels hingedly connected to one of said second pair of shoulder panels;

folding said first and second side wall panels upward approximately 90 degrees relative to said bottom wall;

folding first panels of said first and second pairs of double-paneled minor flaps inward at angles relative to said side wall panels;

folding second panels of said first and second pairs of double-paneled minor flaps inward at angles relative to said first panels;

folding said front and back wall panels upward approximately 90 degrees relative to said bottom wall so that each of said second panels of said first and second pairs of double-paneled minor flaps is adhered to a corresponding one of said front and back wall panels;

folding said first and second surrounded center flanges slightly away from said first and second major flanges;

folding said first and second major flanges toward said first and second center flanges so as to capture said first and second center flanges between, respectively, said first and second major flanges and said front wall panel and said back wall panel, said major first and second major flanges being adhered, respectively to said front and back wall panels;

folding said first and second pairs of shoulder panels inward approximately 90 degrees relative, respectively, to said front and back wall panels;

folding said first and second pairs of dual external reinforcement panels downward approximately 90 degrees relative, respectively, to said first and second pairs of shoulder panels and adhering individual external reinforcement panels to corresponding ones of said side wall panels; and folding said first and second pairs of dual external reinforcement panels along a vertical crease line so that two external reinforcement are adhered to each of said front and back walls.

* * * * *